US008272836B1

(12) United States Patent
Misso et al.

(10) Patent No.: US 8,272,836 B1
(45) Date of Patent: Sep. 25, 2012

(54) PUMP SUCTION ASSEMBLY

(75) Inventors: Mark M. Misso, Middleport, NY (US); James Tomasine, Lockport, NY (US)

(73) Assignee: Lynx Product Group, LLC, Wilson, NY (US)

( * ) Notice: Subject to any disclaimer, the term of this patent is extended or adjusted under 35 U.S.C. 154(b) by 1280 days.

(21) Appl. No.: 12/011,364

(22) Filed: Jan. 25, 2008

(51) Int. Cl.
*F04D 29/44* (2006.01)

(52) U.S. Cl. ..... 415/167; 415/121.2; 415/232

(58) Field of Classification Search ..... 415/1, 912, 415/232, 167, 169.2, 121.3, 121.2, 92, 88, 415/56.1; 137/590
See application file for complete search history.

(56) References Cited

U.S. PATENT DOCUMENTS

| | | | | |
|---|---|---|---|---|
| 1,974,110 | A | | 9/1934 | Higley |
| 3,411,451 | A | | 11/1968 | Matthias et al. |
| 3,421,446 | A | | 1/1969 | Strscheletzly et al. |
| 3,735,782 | A | | 5/1973 | Strscheletzky |
| 3,910,715 | A | | 10/1975 | Yedidiah |
| 4,768,541 | A | * | 9/1988 | Uney et al. ..... 137/154 |
| 4,821,768 | A | | 4/1989 | Lett |
| 4,828,457 | A | | 5/1989 | Bauer et al. |
| 4,973,231 | A | | 11/1990 | Colliver |
| 5,529,084 | A | | 6/1996 | Mutsakis et al. |
| 6,629,814 | B2 | | 10/2003 | McEwen et al. |
| 2001/0018023 | A1 | | 8/2001 | Tagomori et al. |
| 2005/0214143 | A1 | | 9/2005 | Stirling et al. |

FOREIGN PATENT DOCUMENTS

| | | |
|---|---|---|
| JP | 2002-155898 | 5/2002 |
| JP | 2003-148398 | 5/2003 |

* cited by examiner

*Primary Examiner* — Dwayne J White
(74) *Attorney, Agent, or Firm* — Simpson & Simpson, PLLC

(57) ABSTRACT

A pump suction assembly comprising a suction sheet having a receiving hole, a flat central section, a first outer section and a second outer section extending away from the central section at an angle; a pipe having a bend, an inlet portion having at least one vortex flat and directed toward and at least partially disposed in the receiving hole and flush with a bottom of the suction sheet; a tank having a base; at least one standoff arranged to support the first outer section at a perimeter of the first outer section; at least one standoff arranged to support the second outer section at a perimeter of the second outer section; and at least one standoff arranged to support the central section, wherein the inlet portion is directed toward and proximate to the base.

15 Claims, 7 Drawing Sheets

PUMP SUCTION ASSEMBLY

FIELD OF THE INVENTION

The invention relates generally to improvements in fluid transfer apparatuses and more particularly to reducing the amount of fluid in a modular washer. In particular, the invention relates to industrial pump assemblies with higher efficiency in a more compact design.

BACKGROUND OF THE INVENTION

Washing machines have been used for many years in a variety of ways, from typical household clothes washers to heavy duty industrial washers. One of the challenges of designing industrial washers is to maximize their interior capacity while reducing their exterior dimensions so that valuable shop floor space is saved. Larger industrial washers may have a grated floor so that contaminated fluid from the cleaning process drains into a tank below. Advantageously, the grated floor allows the entire area below the grated floor to act as a tank. In addition, since it is cumbersome to install plumbing in the floor of industrial facilities, modular industrial washers are preferred, because they can be located virtually anywhere in a facility, and because they do not require specialized installation.

FIGS. 1 and 2 are a perspective view and an exploded view, respectively, of traditional pump suction assembly 20. Traditional pump suction assemblies include pump suction box 22, screen 24, and screen top 26 which are located at the bottom of a tank. Box 22 also includes tabs (not shown) extending from the bottom to create a gap between the bottom of the box and the screen to allow fluid to enter the bottom of the box. Screen 24 is used to prevent large debris from the contaminated fluid from entering the pump suction assembly and causing damage to the pump or pipes. Screen top 26 fits atop screen 24 to prevent the contaminated fluid from bypassing the screen.

Box 22 has an outlet port 28 that is connected to a pump in order to provide suction for the removal of the contaminated fluid. In operation, the fluid enters box 22 at the bottom and exits through outlet port 28. Box 22 must be of sufficient size to provide adequate fluid to the outlet port in order for the pump to remain primed. In order for a pump to remain primed, fluid must remain in the system. If air is introduced, the pump will lose prime and will be unable to force the fluid through the system.

In a variety of industries, industrial washers are used to acid wash components and fixtures, some of which may include hazardous biological substances. Since traditional pump suction assemblies tend to leave inches of contaminated fluid in a tank, there could be a greater risk of safety and health issues, because the additional contaminated fluid must be manually pumped out or an additional less efficient pump must be used to remove the excess fluid.

While traditional pump suction assemblies have been used for more than thirty years, there is a long-felt need for a more efficient pump suction assembly, especially for a modular tank that is capable of removing more fluid from a tank without increasing the size of the pump or the machine, while still reducing the health risks associated with modular industrial washing machines.

BRIEF SUMMARY OF THE INVENTION

The present invention broadly comprises a pump suction assembly including a tank having a base; a suction sheet having a receiving hole, a flat central section and at least one outer section extending away from the central section at an angle; and a pipe having an inlet portion directed toward the receiving hole; wherein the inlet portion is at least partially disposed in the receiving hole. In a preferred embodiment, the inlet portion is directed toward and proximate to the base. Preferably, the inlet portion is between approximately one-quarter of an inch and approximately three-quarters of an inch from the base and is ideally approximately three-eighths of an inch from the base.

In a preferred embodiment, the suction sheet is sized and shaped to fit the floor of the tank, the at least one outer section is two outer sections, and the angle is slightly upward from the base. In a second preferred embodiment, the present invention comprises a screen wherein the suction sheet and the at least two standoffs are disposed within the screen, while the at least two standoffs are arranged to support the suction sheet.

In yet another preferred embodiment, two standoffs are arranged to support a first of the two outer sections at a perimeter of the first outer section and two standoffs are arranged to support a second of the two outer sections at the perimeter of the second outer section. In a preferred embodiment, the inlet portion is flush with a bottom of the suction sheet and the pipe further includes a bend proximate to the inlet portion, wherein the bend is approximately ninety degrees.

In still another preferred embodiment, the present invention includes at least one vortex flat. In a third preferred embodiment, the at least one vortex flat is two vortex flats. In another preferred embodiment, the present invention further includes a pump connected to the pipe. The pipe is generally circular in shape and has a diameter between approximately one inch and five inches. In a preferred embodiment, the pipe diameter is approximately three inches.

The present invention also broadly comprises a pump suction assembly including a suction sheet having a receiving hole, a flat central section, a first outer section and a second outer section extending away from the central section at an angle; a pipe having a bend, an inlet portion having at least one vortex flat and directed toward and at least partially disposed in the receiving hole and flush with a bottom of the suction sheet; a tank having a base; at least one standoff arranged to support the first outer section at a perimeter of the first outer section; at least one standoff arranged to support the second outer section at a perimeter of the second outer section; and at least one standoff arranged to support the central section; wherein the inlet portion is directed toward and proximate to the base.

The present invention broadly comprises a method for pumping fluid from a tank including the steps of: locating a suction sheet having a receiving hole and at least one tapered outer portion proximate to a base of a tank; disposing a pipe having an inlet portion in the receiving hole; moving a fluid from the at least one tapered portion toward the inlet portion between the suction sheet and the base; accelerating the fluid from the at least one tapered outer portion to the inlet portion to create a smooth flow; creating a turbulent flow of the fluid upon contact with the vortex flat; and evacuating the fluid from the inlet portion through the pipe. In a preferred embodiment, the method further includes the step of disposing the suction sheet in a screen having a plurality of holes and moving the fluid through the plurality of holes before contacting the suction sheet.

It is a general object of the present invention to provide a pump suction assembly which is capable of effectively removing contaminated fluid from a modular industrial washer without increasing the pump size.

It is a general object of the present invention to provide a pump suction assembly which is capable of removing more contaminated fluid than conventional pump suction assemblies.

It is a general object of the present invention to provide a cleaner and safer modular industrial washer.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described. The present invention is generally described using contaminated fluid; however, any liquid substance or suitable gelatinous fluid having the requisite viscosity may be substituted.

Figure 1:
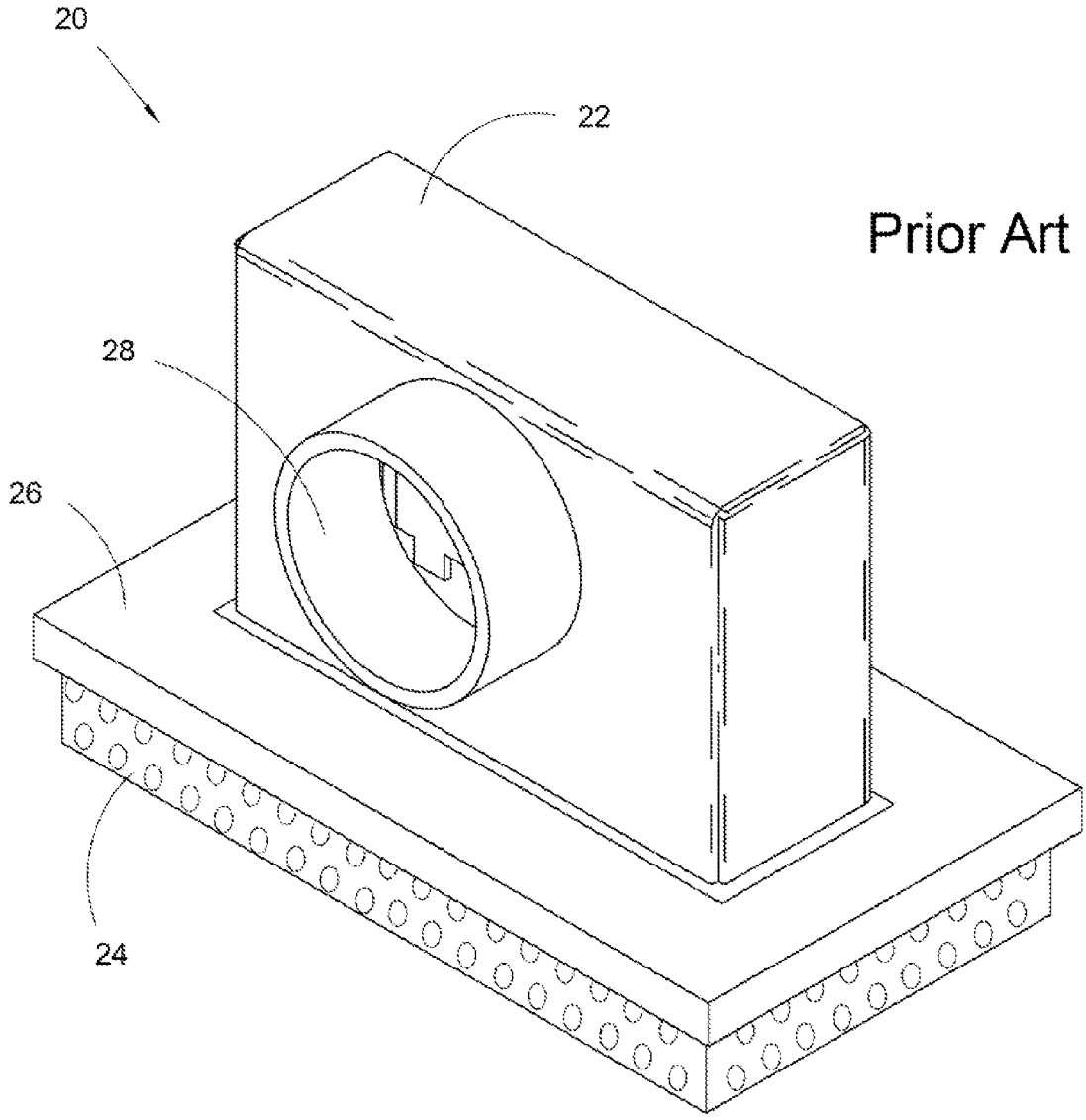
FIG. 1 is a perspective view of a traditional pump suction assembly.
Figure 2:
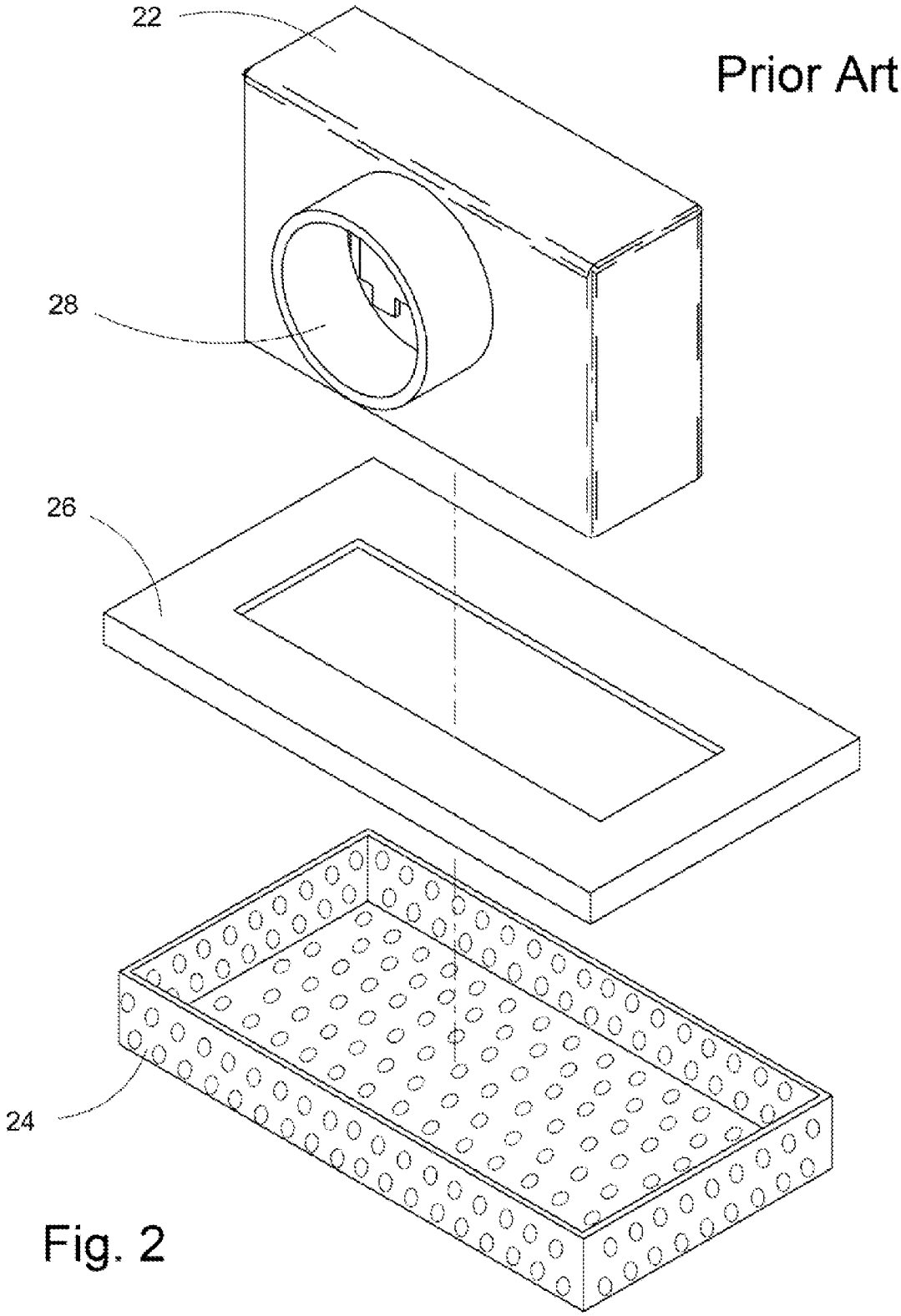
FIG. 2 is an exploded view of a traditional pump suction assembly.
Figure 3:
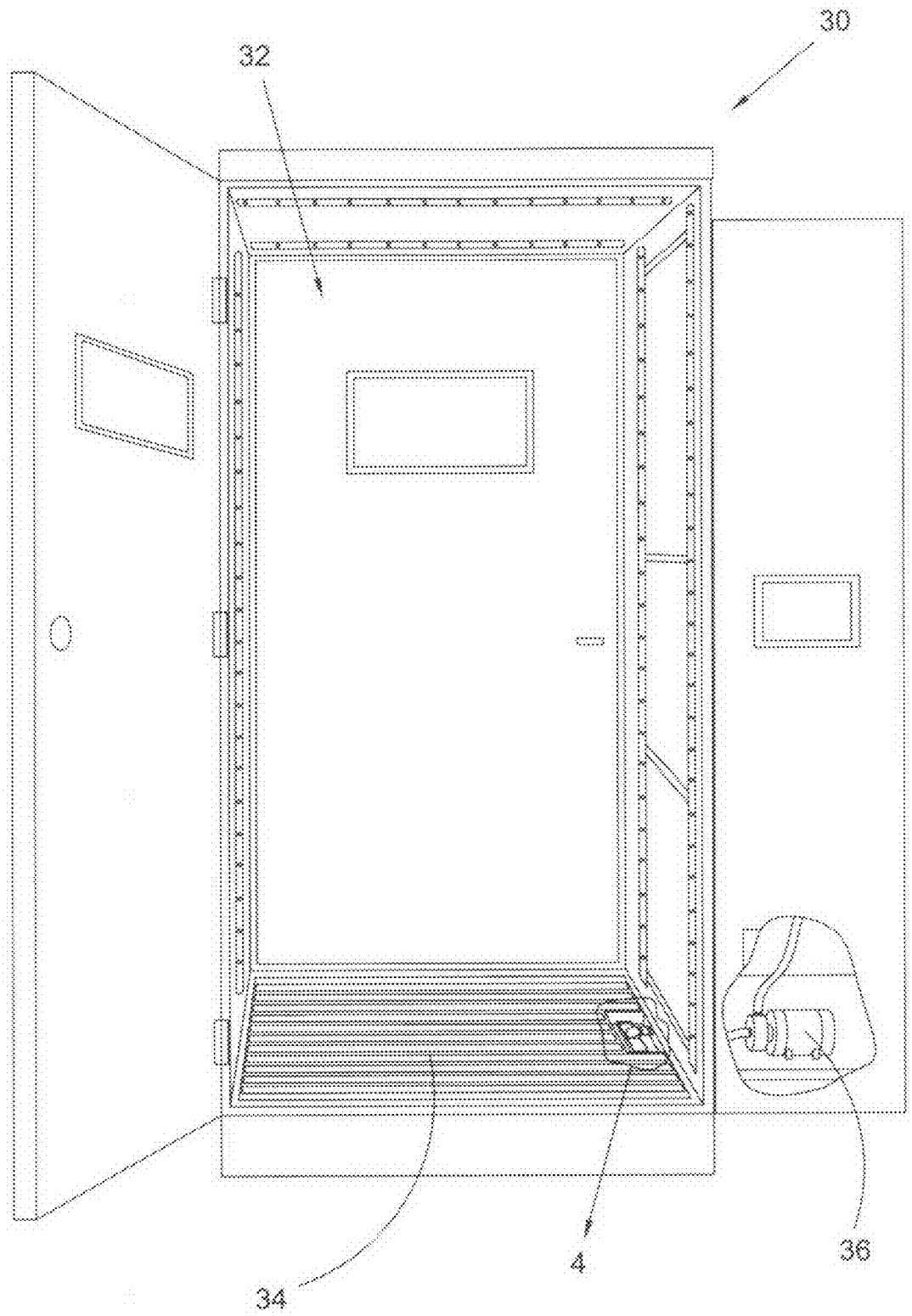
FIG. 3 is a front view of an industrial washer incorporating a preferred embodiment pump suction assembly.

FIG. 3 is a front view of modular industrial washer 30. By modular, we mean that washer 30 is generally self contained and can be relocated as a unit. The major components of washer 30 are central washing cavity 32, grated floor 34, and pump 36, which is connected to suction assembly 40 in encircled region 4. Fluid is sprayed to clean the objects located in cavity 32 and the contaminated fluid flows downward through grated floor 34 until reaching the base of the tank, described infra. Advantageously, the grated floor allows the object to be cleaned and the operator to enter the unit after cleaning without having to stand in the contaminated fluid. In a preferred embodiment, pump 36 is a ten horsepower close coupled pump with an efficiency of approximately 85%, such as the AE47 model manufactured by Emerson Motor Company, although any suitable pump may be incorporated depending upon the viscosity of the fluid to be evacuated and the dimensions of the washer's plumbing.

Figure 4:
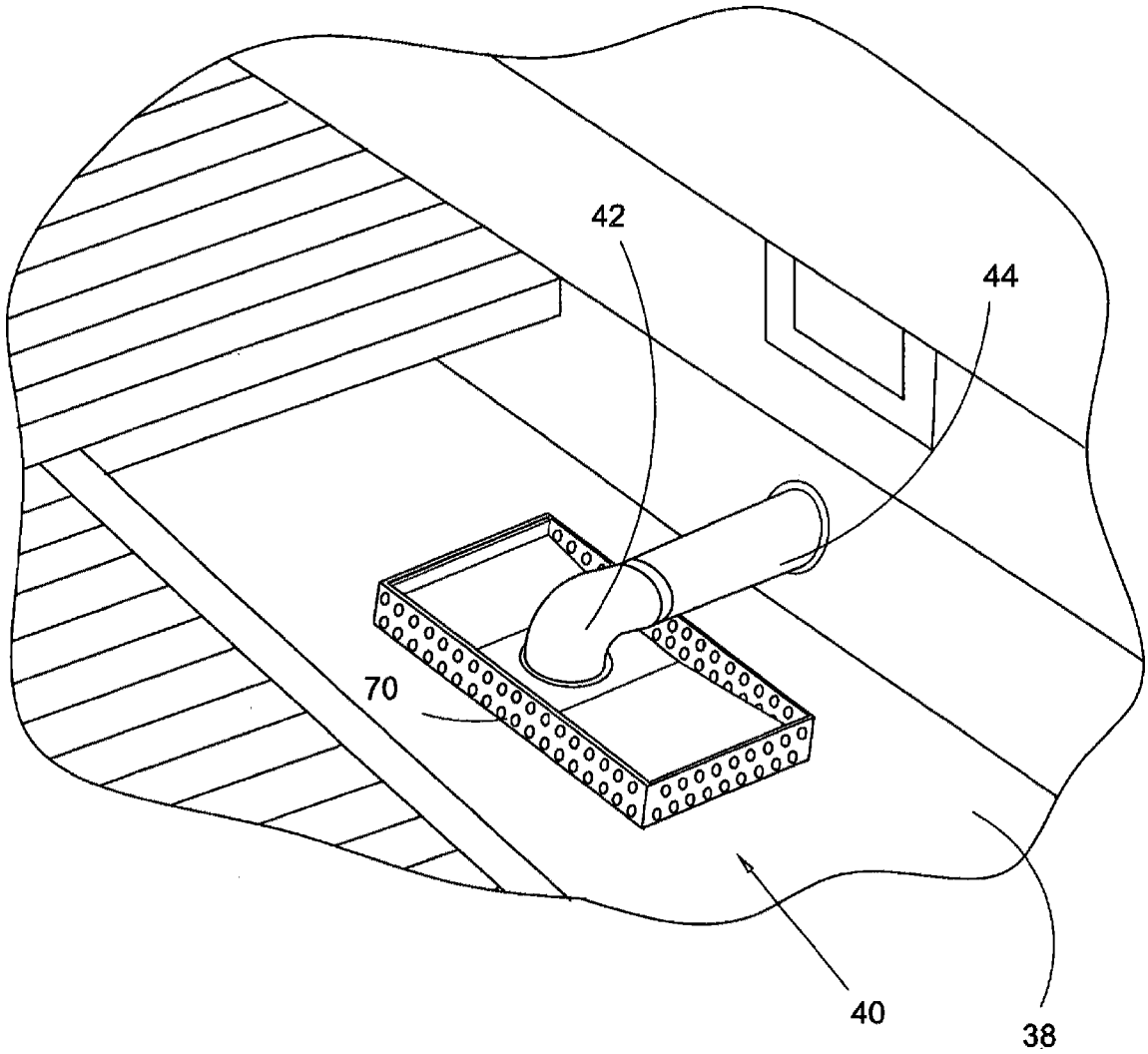
FIG. 4 is an enlarged view of the encircled region 4 in FIG. 3.

FIG. 4 is an enlarged view of encircled region 4 in FIG. 3. Suction assembly 40 rests on the base of tank 38. By base of tank 38, we mean the bottom or floor of tank 38 which is directly below grated floor 34. Suction assembly 40 includes pipe 42 connected to exit pipe 44, and screen 70. In a preferred embodiment, pipe 42 has a diameter between about one inch and about five inches. Preferably, pipe 42 is approximately three inches in diameter and has a round cross-section, although pipe 42 may be any appropriate diameter or shape that is suitable for withdrawing contaminated fluid with pump 36. In operation, contaminated fluid enters suction assembly 40 through holes in screen 70, is then pumped up through suction assembly 40, into pipe 42, and then into exit pipe 44. Next, the contaminated fluid is pumped from modular washer 30 into storage units or any other appropriate disposal structure separate from the washer.

Tank 38 is used to define the area within the washer that is below grated floor 34 and has approximately the same length and width dimensions as cavity 32. The base of tank 38 may also be sloped so that fluid collects in an area proximate to suction assembly 40. However, the base of tank 38 cannot be so severely sloped that it substantially reduces the usable volume of cavity 32 or the fluid storage capacity of the tank. Although the tank is shown below the grated floor, it is within the spirit and scope of the present invention to remove grated floor 34 and locate the object to be cleaned directly on the base of tank 38, particularly in applications where hazardous chemicals or materials are not involved.

Figure 5:
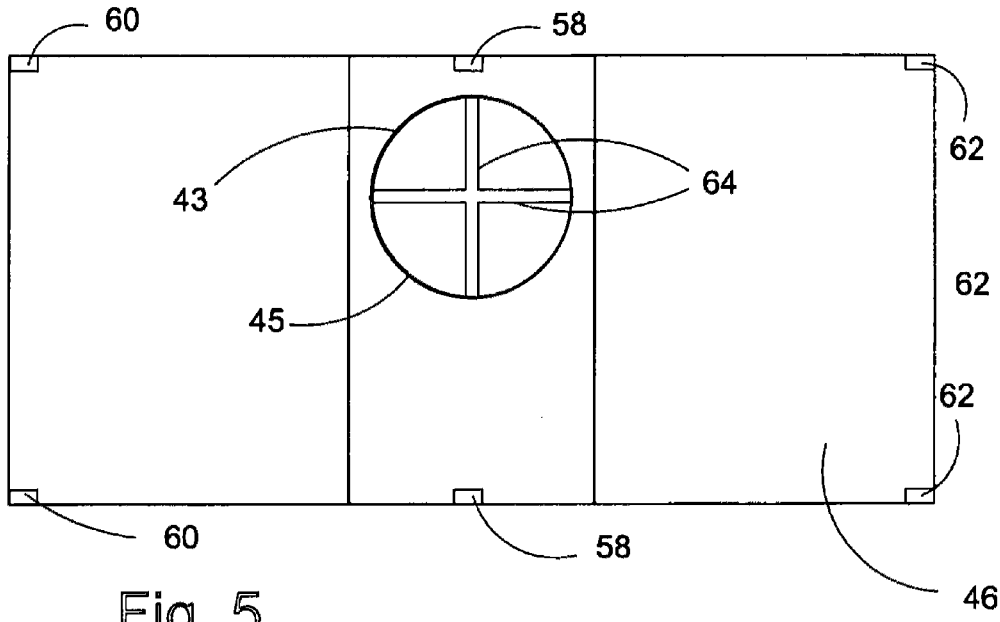
FIG. 5 is a bottom view of a preferred embodiment pump suction assembly suction sheet and pipe.
Figure 6:
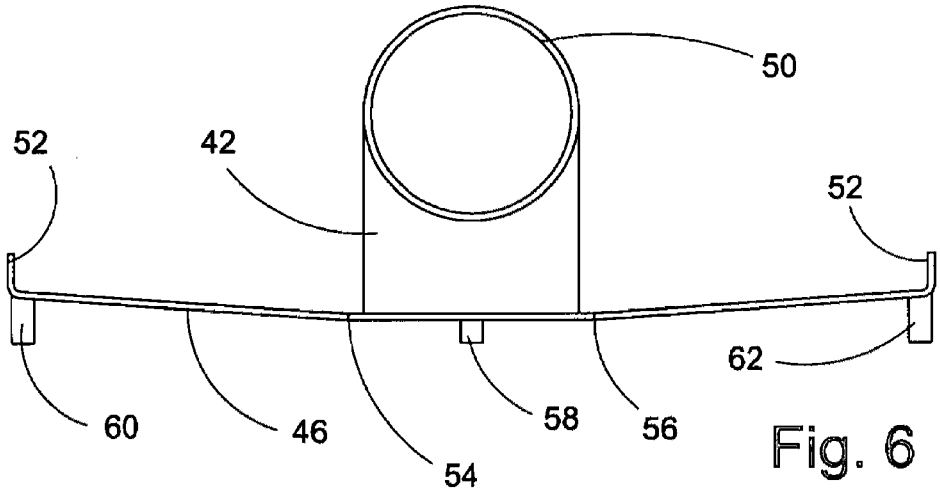
FIG. 6 is a front view of a preferred embodiment pump suction assembly suction sheet and pipe.
Figure 7:
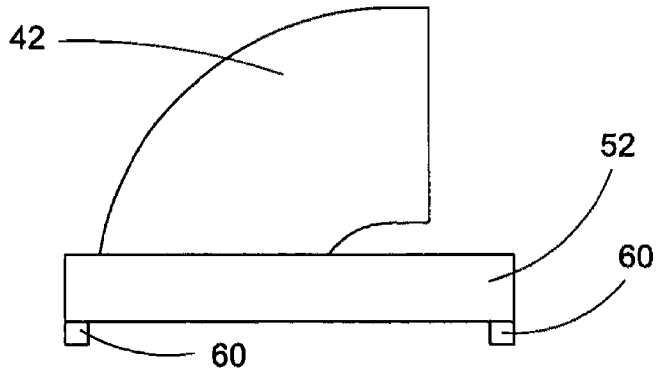
FIG. 7 is a side view of a preferred embodiment pump suction assembly suction sheet and pipe.

The following should be viewed in light of FIGS. 5 through 7 where screen 70 of suction assembly 40 has been removed. FIG. 5 is a bottom view of suction sheet 46 and pipe inlet portion 43. FIGS. 6 and 7 are a front view and side view, respectively, of suction sheet 46 and pipe 42. Suction sheet 46 is located within screen 70 as described supra.

In FIG. 5, suction sheet 46 rests on central standoffs 58, left standoffs 60, and right standoffs 62. Central standoffs 58 are generally shorter than left standoffs 60 and right standoffs 62 due to the slightly upward angle of suction sheet 46 as it extends from the central portion as described infra. Left standoffs 60 and right standoffs 62 support suction sheet 46 at the left perimeter and the right perimeter, respectively. The standoffs allow suction sheet 46 to be raised to facilitate fluid flow on the bottom side of the suction sheet. By bottom side of suction sheet 46, we mean the underside of the suction sheet or the surface which rests on standoffs 58, 60, and 62.

In a preferred embodiment, central standoffs 58 are between one-quarter of an inch and three-quarters of an inch in height. Preferably, central standoffs are approximately three-eighths of an inch in height so that inlet portion 43 is three-eighths of an inch from the base of tank 38. Although suction sheet 46 is shown and described using standoffs, one of ordinary skill in the art should immediately recognize that suction sheet 46 could be modified such that the outer edges of the suction sheet rest on screen 70 or another suitable substitute, thereby rendering standoffs, 58, 60, and 62 unnecessary, which modifications are within the spirit and scope of the invention as claimed.

Pipe 42 includes inlet portion 43 with vortex flats 64. Although the vortex flats are shown as a pair of perpendicular pieces of sheet metal, any adequate arrangement and material of vortex flats can be used and is within the spirit and scope of the invention as claimed. Vortex flats 64 function as a vortex breaker and are used to create turbulent flow and increase the fluid velocity. Advantageously, pipe inlet portion 43 is located flush with the bottom of suction sheet 46. By flush with the bottom of suction sheet 46, we mean that pipe 42 is disposed within receiving hole 45 such that the outer edge of inlet portion 43 does not protrude beyond the bottom of suction sheet 46.

In this arrangement, inlet portion 43 is directed toward and proximate to the base of tank 38. Since pipe inlet portion 43 is flush with the bottom of suction sheet 46, when contaminated fluid is directed toward pipe inlet portion 43, the sharp edge created at the meeting point of inlet portion 43 and the bottom of suction sheet 46 creates an eddy. By an eddy, we mean the fluid along the connection of the inlet portion 43 and the bottom of suction sheet 46 reverses flow and swirls, creating a space where fluid does not flow downstream. The eddy helps to increase fluid velocity and allows for more efficient evacuation of the contaminated fluid.

Adverting to FIGS. 6 and 7, suction sheet 46 further includes raised edges 52 and bends 54 and 56. Since suction sheet 46 is shown and described as rectangular, there are two bends 54 and 56. However, it should be apparent to one of ordinary skill in the art that any number of bends can be incorporated depending upon the shape and size of the suction sheet, so long as a flat central portion remains. Bends 54 and 56 create a flat central portion located between the bends. Further outward from bend 54 and bend 56 are outer sections that extend at an angle with respect to the flat central portion and the base of tank 38. The angled outer portions increase the volume below suction sheet 46 as the outer portions extend away from the central portion. Since the volume below suction sheet 46 decreases from the outer portion toward the central portion, fluid flow velocity will increase advantageously.

Pipe 42 includes outlet portion 50 that connects to exit pipe 44. Pipe 42 also includes a bend proximate to inlet portion 43 as the pipe extends away from receiving hole 45. In a preferred embodiment, the bend is approximately ninety degrees, such that the suction assembly intakes the contaminated fluid in a vertical orientation and exhausts the contaminated fluid in a horizontal orientation. Although pipe 42 is described with a ninety degree bend, any suitable pipe orientation which allows the washer to remain modular and still provide adequate suction without increasing the pump size is within the spirit and scope of the invention as claimed.

Figure 8:
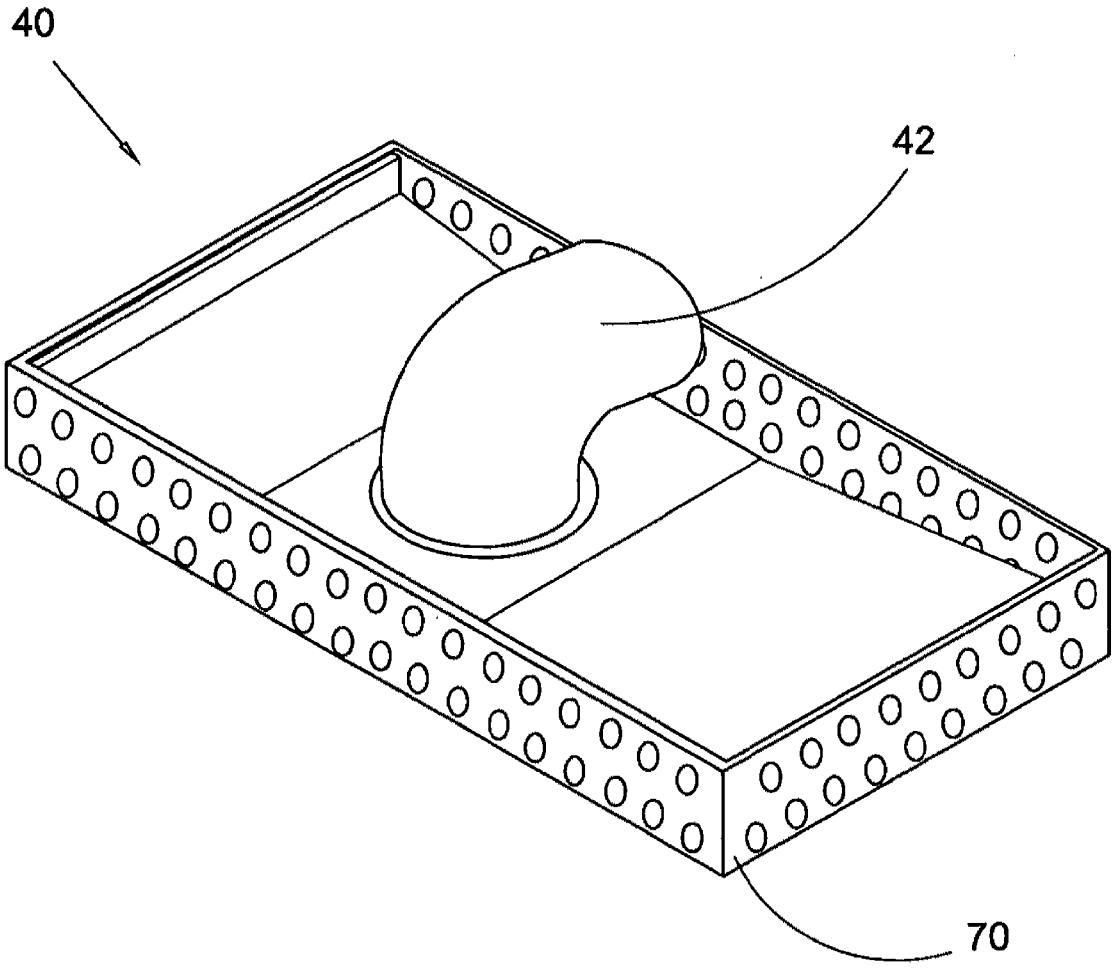
FIG. 8 is a front perspective view of a preferred embodiment pump suction assembly; and, FIG. 9 is an exploded view of a preferred embodiment pump suction assembly.

FIG. 8 is a perspective view of pump suction assembly 40 resting within screen 70. In this arrangement, contaminated fluid cannot enter pipe 42 without first passing through the holes in screen 70. Screen 70 acts as a filter by preventing clogging of suction assembly 40 by large objects.

Figure 9:
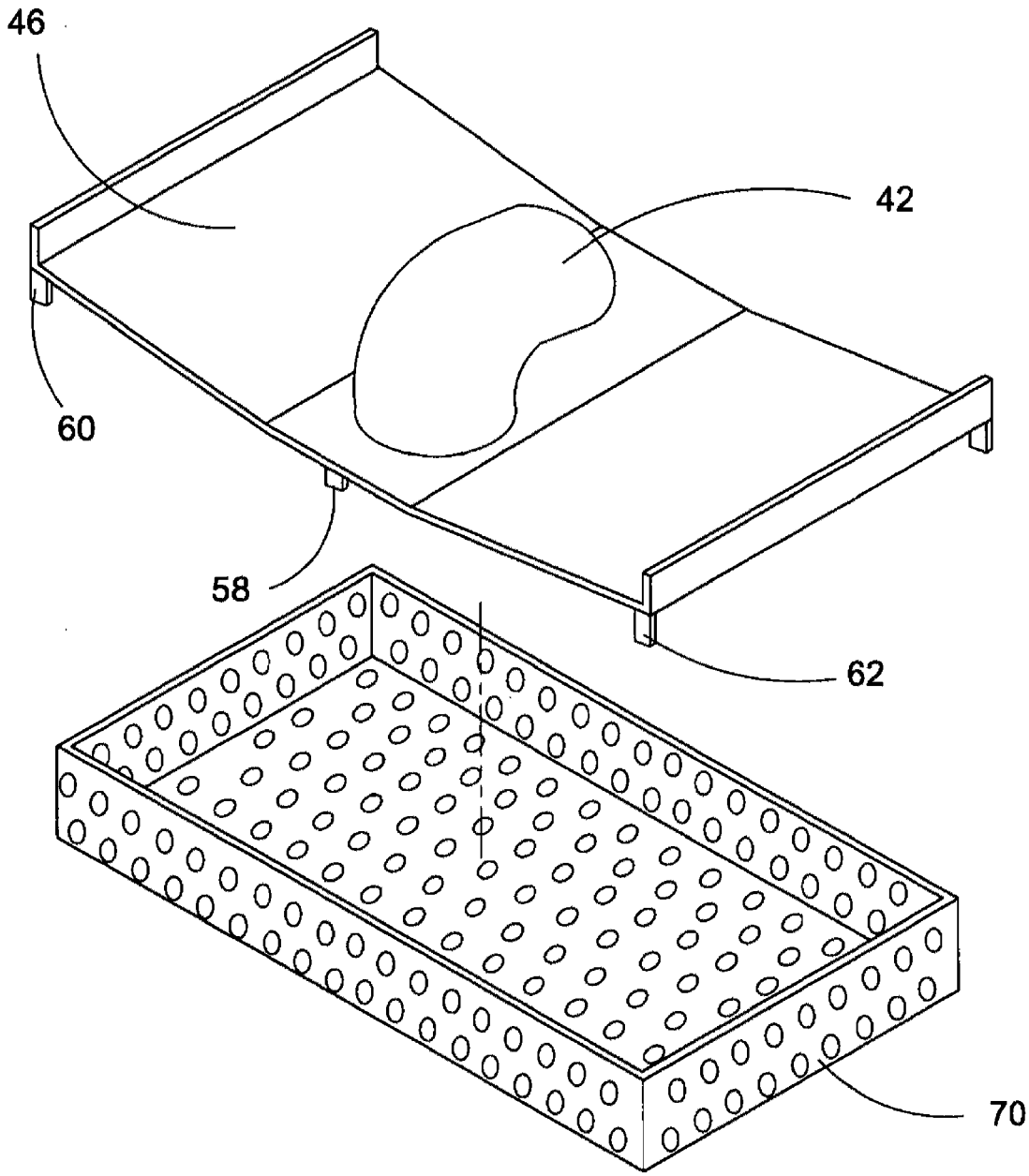

FIG. 9 is an exploded view of pump suction assembly 40 with suction sheet 46 and pipe 42 housed within screen 70. Standoffs 58, 60, and 62 are located between the screen and the suction sheet to provide the necessary clearance, while still allowing contaminated fluid to travel around the standoffs, since the standoffs are usually small.

In a preferred embodiment, the components of suction assembly 40 are composed of sheet metal and stamped in the various required shapes. However, the components could be composed of any other suitable material including, but not limited to, aluminum, aluminum alloys, stainless steel, titanium, titanium alloys, zinc alloys, and plastic. While stamping is the preferred method of manufacturing the components of the suction assembly, the components may be manufactured by any suitable process including, but not limited to, stretching, drawing, punching, shearing, or pressing. Although suction assembly 40 has been illustrated and described as having a generally rectangular shape, any shape suction assembly may be substituted including but not limited to circular, square, triangular, or octagonal, as well as irregular shapes.

The following should be viewed in light of FIGS. 3 through 9. The present invention further includes a method for pumping fluid from a tank. Although the method is described as a sequence of steps for clarity purposes, no order should be inferred unless explicitly stated, where the first step in pumping fluid from a tank is locating suction sheet 46 having receiving hole 45 and at least one tapered outer portion proximate to the base of tank 38. By at least one tapered portion, we mean the angled portion described and defined supra. Another step is disposing inlet portion 43 of pipe 42 within receiving hole 45. Yet another step is moving contaminated fluid from the at least one tapered portion toward inlet portion 43 to create a smooth laminar flow. Another step is creating a turbulent flow of the contaminated fluid upon contact with inlet portion 43. Still another step is creating a turbulent flow of the contaminated fluid upon contact with vortex flats 64. The final step is evacuating the contaminated fluid from inlet portion 43 with pump 36.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

The invention claimed is:

1. A pump suction assembly comprising:

a tank having a base;

a suction sheet having a receiving hole, a flat central section and at least one outer section extending away from said central section at an angle;

a pipe having an inlet portion directed toward said receiving hole; and, wherein said inlet portion is at least partially disposed in said receiving hole;

wherein said inlet portion is directed toward and proximate to said base and said inlet portion is between approximately one-quarter of an inch and three-quarters of an inch from said base.

2. The pump suction assembly of claim 1 wherein said inlet portion is approximately three-eighths of an inch from said base.

3. The pump suction assembly of claim 1 wherein said inlet portion is flush with a bottom of said suction sheet.

4. The pump suction assembly of claim 1 further comprising at least one vortex flat.

5. The pump suction assembly of claim 4 wherein said at least one vortex flat is two vortex flats.

6. The pump suction assembly of claim 1 further comprising a pump connected to said pipe.

7. A pump suction assembly comprising:

a suction sheet having a receiving hole, a flat central section, a first outer section and a second outer section extending away from said central section at an angle;

a pipe having a bend, an inlet portion having at least one vortex flat and directed towards and at least partially disposed in said receiving hole and flush with a bottom of said suction sheet;

a tank having a base;

at least one standoff arranged to support said first outer section at a perimeter of said first outer section;

at least one standoff arranged to support said second outer section at a perimeter of said second outer section;

at least one standoff arranged to support said central section; and, wherein said inlet portion is directed toward and proximate to said base;

wherein said tank includes a grated floor positioned above said pump suction assembly.

8. A method for pumping fluid from a tank comprising the steps of:

locating a suction sheet having a receiving hole and at least one tapered outer portion proximate to a base of a tank;

disposing a pipe having an inlet portion in said receiving hole;

moving a fluid from said at least one tapered portion toward said inlet portion between said suction sheet and said base;

accelerating said fluid from said at least one tapered outer portion to said inlet portion to create a smooth flow;

creating a turbulent flow of said fluid upon contact with said inlet portion; and, evacuating said fluid from said inlet portion through said pipe.

9. A pump suction assembly comprising:

a tank having a base;

a suction sheet having a receiving hole, a flat central section and at least one outer section extending away from said central section at an angle;

a pipe having an inlet portion directed toward said receiving hole; and, wherein said inlet portion is at least partially disposed in said receiving hole;

wherein said suction sheet is generally rectangular in shape, said at least one outer section is two outer sections, and said angle is slightly upward from said base.

10. The pump suction assembly of claim 9 further comprising at least two standoffs arranged to support said suction sheet.

11. The pump suction assembly of claim 10 further comprising a screen wherein said suction sheet and said at least two standoffs are disposed within said screen.

12. The pump suction assembly of claim 9 further comprising two standoffs arranged to support a first of said two outer sections at a perimeter of said first outer section and two standoffs arranged to support a second of said two outer sections at the perimeter of said second outer section.

13. The pump suction assembly of claim 9 wherein said inlet portion is flush with a bottom of said suction sheet.

14. The pump suction assembly as recited in claim 9 further comprising at least one vortex flat.

15. The pump suction assembly of claim 14 wherein said at least one vortex flat is two vortex flats.

* * * * *